United States Patent [19]

Carlson

[11] 4,202,404

[45] May 13, 1980

[54] CHILL ROLL CASTING OF AMORPHOUS METAL STRIP

[75] Inventor: Charles E. Carlson, Succasunna, N.J.

[73] Assignee: Allied Chemical Corporation, Morris Township, Morris County, N.J.

[21] Appl. No.: 453

[22] Filed: Jan. 2, 1979

[51] Int. Cl.[2] ..... B22D 11/00

[52] U.S. Cl. ..... 164/423; 164/87; 164/429

[58] Field of Search ..... 164/87, 423, 433, 429, 164/441, 427

[56] References Cited

U.S. PATENT DOCUMENTS

| | | | |
|---|---|---|---|
| 359,348 | 3/1887 | Daniels | 164/433 X |
| 905,758 | 12/1908 | Strange et al. | 164/429 |
| 1,220,211 | 3/1917 | Feldkamp et al. | 164/434 |
| 3,785,428 | 1/1974 | Hazelett et al. | 164/433 |
| 3,856,074 | 12/1974 | Kavesh | 164/87 |
| 3,862,658 | 1/1975 | Bedell | 164/87 |
| 4,069,860 | 1/1978 | Ward | 164/433 X |

*Primary Examiner*—Robert D. Baldwin
*Assistant Examiner*—Gus T. Hampilos
*Attorney, Agent, or Firm*—Gerhard Fuchs; Horst M. Kasper

[57] ABSTRACT

Improvement in apparatus for making metal filament by depositing molten metal onto the flat peripheral surface of a rotating annular chill roll includes provision of an elastomeric flexible belt supported by at least three guide wheels, carried in frictional engagement with said surface for urging the filament into prolonged contact with said surface.

8 Claims, 3 Drawing Figures

CHILL ROLL CASTING OF AMORPHOUS METAL STRIP

FIELD OF THE INVENTION

This invention relates to the art of casting metals, especially glass forming metal alloys by the melt spin process wherein a stream of molten metal is deposited in the peripheral surface of a rotating annular chill roll.

BACKGROUND OF THE INVENTION

For purposes of the present invention, a filament is a slender body whose transverse dimensions are much less than its length. In that context, filaments may be bodies such as ribbons, strips, sheets or wires, of regular or irregular cross section. As used herein, an "amorphous filament" is a filament of a metal alloy having amorphorus molecular structure.

It is known to make metal filaments by directing a jet of molten metal against a rotating quench surface, or by otherwise depositing molten metal on such quench surface, whereon it is solidified in the form of a ribbon and is flung away by action of centrifugal force, as for example described by Strange and Pim in U.S. Pat. No. 905,758. In the procedure described by Strange and Pim the quench surface is furnished by a rotating chill roll. That procedure is suitable to form filaments of many of the polycrystalline metals which possess sharp melting points, that is to say, which have solid-liquid transition range of less than about 4° C. However, glassy metals having amorphous molecular structure often have a transition range in the order of about 400° C. or more through which the viscosity of the metal gradually increases until the critical glass transition temperature is reached, and it is necessary for the filament to be quenched below its glass transition temperature before departure from the quench surface. This is difficult to achieve by the procedure of Strange and Pim because centrifugal action tends prematurely to fling the filament away from the chill roll. Also, in that procedure the point of release of the filament from the surface of the chill roll varies, so that it is difficult to collect the filament and to guide it to a suitable winder.

Shortcomings concerning insufficiency of retention time of filament on the surface of the chill roll, and difficulties in collecting the filament from a variable point of release, are overcome by the procedures described by Kavesh in U.S. Pat. No. 3,856,074 and Bedell in U.S. Pat. No. 3,862,658. The Kavesh procedure involves retention of filaments formed on the exterior surface of a rotating chill roll by use of nipping means; the Bedell procedure involves prolonging the period of contact between the filament and the chill roll by exerting a force against the surface of the chill roll in the direction towards the axis of rotation of the chill roll by devices such as gas jets, moving metal belts and rotating wheels. In a specific embodiment Bedell employs a metal belt of beryllium copper running over two rollers for confining the ribbon to prevent early separation from the chill roll. However, use of two rollers imposes geometrical and practical limitations as to the angle over which the ribbon can be urged against the rotating chill roll, and when the contact angle of the ribbon with the roll is small, a wavy ribbon may result. Moreover, use of a metal belt inherently involves danger of damaging the highly sensitive surface of the chill roll, as by marring it because of solid-to-solid contact between the surface of the chill roll and the relatively rigid, and relatively hard metal belt. The slightest imperfection in the surface of the chill roll will be noticeable on the surface of the filament formed, resulting in a product of inferior appearance. Furthermore, unless the belt is narrower than the filament, or at least not wider than the filament, then the belt will be subject to severe buckling, as the section in contact with the hot filament will undergo thermal expansion, whereas the marginal portions not in contact with the filament will not undergo such expansion. However, unless the belt is wider than the filament, the marginal portions of the filament will tend to be unevenly quenched, resulting in filament having uneven properties.

Wheel-and-band type metal casting machines for continuous casting of metallic strip wherein molten metal is deposited into the cavity formed between a grooved casting wheel and a metal retaining band moving together with the casting wheel have been known for some time. Such machines may employ a multiplicity of guide and/or driving wheels for the metal band. For example F. A. Feldkamp et al. in U.S. Pat. No. 1,220,211 disclose such a wheel and band type casting machine. Feldkamp et al.'s apparatus employs a casting wheel having a series of equidistant studs or cores protruding into the casting cavity to provide perforated strip product.

SUMMARY OF THE INVENTION

An apparatus for the production of continuous metal strip by depositing molten metal onto the peripheral surface of a rapidly rotating annular chill roll is improved. Said apparatus includes an annular chill roll adapted for rapid rotation around its longitudinal axis having a flat peripheral casting surface. A means for depositing molten metal onto said casting surface for rapid solidification thereon is provided to form a continuous metal filament.

An elastomeric flexible belt is carried in frictional engagement with said casting surface in an arcuate portion of at least 120° around said chill roll beginning at a point upstream from the point where the filament would be flung away from the casting surface by action of centrifugal force, adapted to urge said solidified filament into contact with said casting surface, said belt being supported by at least three guide wheels. The belt is wider than the filament so that it overlaps the marginal portions of the filament and direct contact between the casting surface and the belt is established immediately adjacent to the marginal portions of the filament. For the sake of convenience, the flexible belt together with its associated support equipment is hereinafter referred to as "hugger belt." Preferably means for tightening is provided for controlling the hugger belt tension.

The filaments made using the hugger belt apparatus of the present invention are straight and have a uniform structure as well as improved physical and magnetic properties. The guidance of the filament provided by the hugger belt fixes the release point of the filament from the chill wheel and then aids capture of the initial lengths of the filament on a winder.

DETAILED DESCRIPTION OF THE INVENTION

Figure 1:
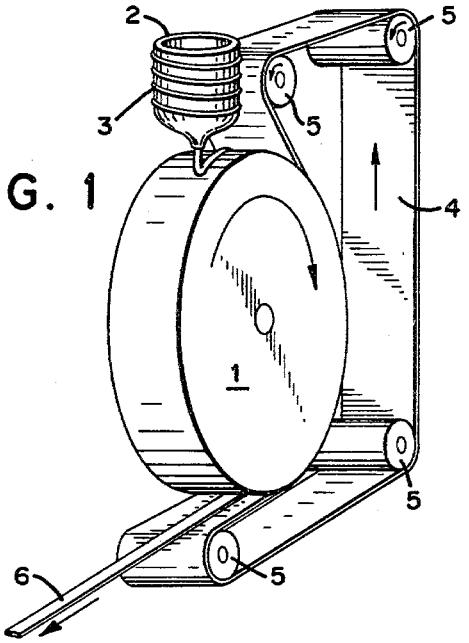
FIG. 1 illustrates the use of a hugger belt apparatus in connection with a chill roll casting apparatus.

A belt is an endless strip of flexible material.

A roll for the purposes of the present disclosure is a surface rotating around an axis and generated by a straight line parallel to the axis and adapted to support a filament to be retained. A wheel having such surface is considered to have a flat peripheral surface. There are two kinds of wheels involved in the apparatus of the present invention; namely, a casting wheel (chill roll) whereon filament formation takes place and guide wheels, which confine the path of the belt. The guide wheels are placed with their axis parallel to the axis of the casting wheel.

The apparatus of the present invention for making metal filaments includes a rotably mounted annular chill roll having a cylindrical peripheral casting surface; means for depositing molten metal onto the peripheral surface of the rotating chill roll; an elastomeric flexible belt for confining the filament over an angle of at least about 120° into contact with the casting surface, and auxiliary equipment associated with the flexible belt for guiding and tensioning the belt into the desired contact with the annular chill roll, said auxiliary equipment including at least three guide wheels.

The chill wheel is of conventional construction. The peripheral surface of the chill roll which provides the actual quench surface can be any material having sufficient structural strength and thermal resistance and having relatively high thermal conductivity. This latter requirement is particularly critical if it is desired to make filament having amorphous or metastable molecular structure. Preferred materials of construction for the chill roll include beryllium copper, oxygen-free copper and stainless steel. To provide protection against corrosion, erosion or thermal fatigue, the peripheral surface of the chill roll may be coated with a suitable resistant or high melting point coating, for example, a ceramic coating or a coating of corrosion-resistant metal, which coating may be applied by known procedures.

The molten metal which is to be formed into a filament may be deposited onto the peripheral surface of the chill roll by any suitable means. For purposes of the present invention, the means by which this is accomplished are not critical. One suitable method is illustrated in the drawings and involves heating the metal, preferably in inert atmosphere or under atmospheric pressure, to temperature approximately 50° to 100° C. above its melting point, or higher, and then ejecting the molten metal through a nozzle for deposition onto the chill roll, as by pressurizing the metal with an inert gas to a pressure on the order of, say, 1 to 50 psig or until a stream of molten metal is ejected through the nozzle.

After deposition on the casting surface, the molten metal is rapidly quenched to the solid state to form a filament and momentum is transferred to the filament which is tangential in the direction of the motion of the chill roll surface. Depending on the configuration, the forces present, and the adhesion of the filament to the chill roll surface, the filament will tend to be flung away from the chill roll surface.

In chill casting processes for making metal filament by depositing molten metal onto the peripheral surface of an annular chill roll it may be desirable to keep the filament in contact with the surface of the chill roll over an extended angle. Such need arises in particular in processes for quenching glassy alloy compositions from the liquid state to the amorphous solid state. To obtain the amorphous solid state, it is necessary to chill the metal at high rates such as between about $10^4$° C./sec. to $10^6$° C./sec. and higher. In many cases the surface of the rotating chill roll moves at very high speeds, perhaps as high as 25 m/sec (about 60 mph) or even higher, and this in turn results in generation of high centrifugal forces which tend to fling the filament away from the casting surface prematurely. Such premature separation frequently results in wavy filaments or in filaments which are not fully amorphous due to insufficient quenching for lack of sufficiently long contact with the chill surface.

The elastomeric, flexible belt which is wider than the filament so that it overlaps the marginal portions of the filament to establish direct contact between the casting surface and the belt immediately adjacent to the marginal portions of the filament, which is driven by the chill roll with which it is in frictional engagement, and which is adapted to urge the filament against the chill roll in an arcuate portion of at least about 120°; permits thorough quenching of the filament throughout its width and results in formation of filament having uniform mechanical and magnetic properties throughout.

The belt is carried over at least three guide wheels. The first and second guide wheels provide for the belt to contact the chill roll over the desired angle and tangentially at two points defining the angle, and going from there to the third guide wheel.

The third and possibly additional guide wheels prevent the part of the looped belt running between the first and second guide wheels and counter directional with the chill roll surface from touching that portion of the belt running codirectionally and in contact with the chill roll surface by restraining the path of the belt to an area removed from the chill roll. The employment of three or more guide wheels easily permit retention of the filament in contact with the rotating chill roll for angles up to nearly full circle, such as between about 120° and 320° and preferably between about 150° and 240°.

As previously stated the belt is driven by frictional engagement with the chill roll surface. Consequently slippage of the filament between belt and the quench surface is avoided, and the filament is not subjected to longitudinal stresses as it is being quenched in contact with the quench surface, so that the filament after release from the chill roll is straight and non-wavy.

A tensioning mechanism for the belt can be provided for by adjusting the spacing of one or more of the guide wheels and thereby tensioning the belt.

To avoid the necessity of taking up the slack in belts which have become stretched and permanently lengthened, a spring loaded belt-tightener may be employed, wherein a spring is employed to urge a guide wheel in a direction away from the other guide wheels against the restraint of the belt which envelops the guide wheels.

Belts suitable for use in the present invention cannot be made of metal, for the aforestated reasons, but must be made of an elastomeric material. Such elastomeric materials include natural as well as synthetic rubber, e.g. those based on butadiene, isoprene, and chloroprene as well as their copolymers, for example copolymers thereof with styrene, halogenated styrenes, acrylonitrile, unsaturated ketones, such as methyl vinyl ketone or methyl isopropenyl ketone, alkyl acrylates, acrylic and methacrylic acid and the like.

Further included are butylene polymers and the ethylene/propylene rubbers, polysulfide rubbers, polyester-based elastomers, polyurethane elastomers, fluoro elastomers, and elastomeric silicones. The latter are a preferred class of elastomers because of their relatively high heat stability.

Desirably the belt is internally reinforced by means of flexible cords, such as cotton, rayon, nylon, polyester, fiberglass or metal wire.

For purposes of the present invention, fiberglass-reinforced silicone rubber belts are preferred. The silicone rubber can be about 75 microns thick on each side of the fiberglass reinforcement, and the belt may have a total thickness in the order of about 0.5 mm. Belt thickness, however, is not a critical parameter so long as the belt has sufficient flexibility to follow the path determined by the guide wheels. Such belts are sold by Belting Industries Co., Inc., Kenilworth, N.J. Such belts have suitable temperature stability and strength, and they are sufficiently soft so as to prevent damage to the chill surface. Prior to first use, such belts can be cured at a temperature of between about 200° C. and 350° C. for a time of between about 10 minutes and 10 hours. It was found that when new, such curing can prevent contamination of the surface of the casting wheel. Cured silicon glass fiber hugger belts were found not to block wetting of the casting wheel by the melt. Curing is not indispensable and belts can be used as supplied by the manufacturer. Employing a hugger belt system providing for contact of the glassy ribbon with the chill wheel over an angle of about 180° results in straight and non-wavy ribbons.

Figure 3:
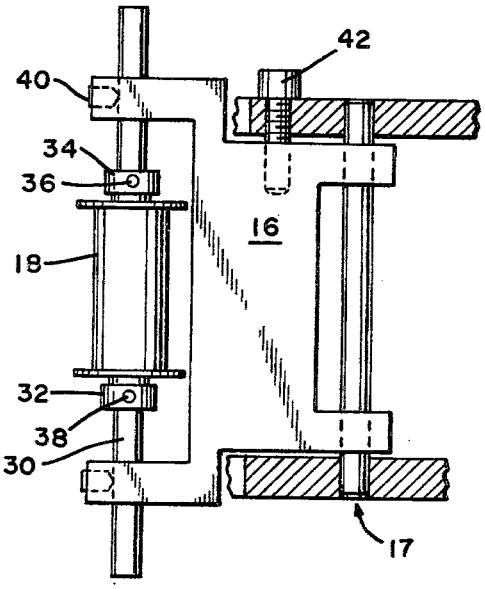
FIG. 3 shows an isometric view of a belt restraining and tensioning provision.
Figure 2:
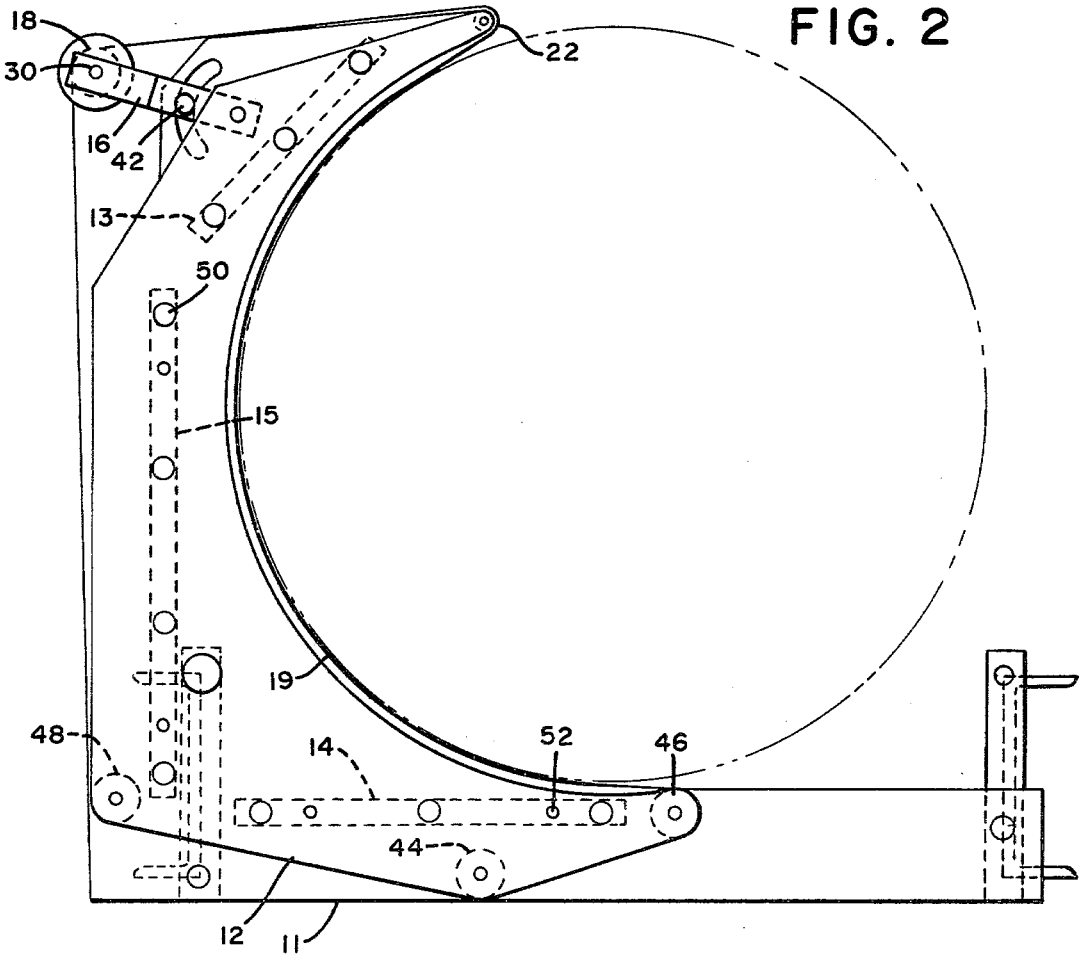
FIG. 2 shows an isometric elevation view of the hugger belt system in direction of the rotational axis.

Referring now to FIG. 1, which in simplified form illustrates the operation of the present invention there is shown a rotating casting roll 1. A container 2 equipped with induction heating coils 3 holds liquid metal alloy, which is deposited on the rotating casting roll 1 whereon it solidifies into filament 6. An elastomeric belt 4 is supported by guide wheels 5 and moves codirectionally with the rotating roll 1. Belt 4 retains the filament 6 against the casting roll. Belt 4 is wider than the filament 6, and is carried in direct contact with the peripheral surface of casting roll 1. FIGS. 2 and 3 provide construction details of exemplary apparatus of the present invention employing five guide wheels.

With reference to FIG. 2, the hugger belt system is supported by a back plate 11 and a front plate 12. The plates are made of a material having sufficient strength and durability, for example stainless steel type 304. The thickness of the stainless steel plates 11 and 12 is ¼". Bridge plates 13, 14 and 15 are provided for appropriate spacing of front and back plates, and for rigidity of the assembled hugger belt system. An idler arm 16 is provided which can be adjusted around an axis 17 for providing proper tension to the belt 19 by changing the position of guide wheel 18. A large socket head cap screw 42 is employed to lock idler arm 16 in desired position. A guide means can be attached to one of the guide wheels for fixing the position of the belt in the direction of the rotational axis of the wheel. Such guide means can be provided by flanges attached to at least one of the guide wheels. For example, shaft 30 in FIG. 2 provides support for guide wheel 18. The guide wheel 18 can rotate around the shaft 30 by a bearing connection (not shown). Collars 32 and 34 permit positioning guide wheel 18 on shaft 30. Set screws 36 and 38 are provided for fixing a desired position of the guide wheel 18 along the length of the shaft 30. A set screw 40 is provided to hold the shaft 30 in the idler arm 16.

Guide wheels 22, 44, 46 and 48 can have about 2.5 cm diameter. Socket head cap screws 50 can be employed to fasten the bridges and the plates together. Dowels 52 can be employed in addition to provide rigidity for the assembly of plates and bridges.

EXAMPLE 1

A metallic glass alloy was cast with the apparatus of FIGS. 2, 3. The copper casting wheel was run at a surface speed of about 15 m/sec and had a diameter of about 37.5 cm. The temperature of the cooling water for the casting wheel was about 30° C. Approximately 1.2 kg of ribbon was cast and the running time was between 60 and 90 seconds.

The belt was a double fiberglass fabric coated with silicon rubber and the belt width was about 5 cm. The belt was driven by the transfer of momentum from the rotating casting wheel through contact friction. The belt tension was adjusted to insure good contact of casting wheel and belt. The belt was kept in position on the casting wheel by the guide wheel having flanges. The belt made initial contact with the casting wheel approximately 30° away from the casting point and the departure point was about 135° from top dead center. The guide wheels restraining the belt where tangential to the casting wheel were mounted for providing a clearance of about 3 mm to 5 mm between the guide wheels and the casting wheel surface so that when the belt was in place and tensioned, there was no pinching between the guide wheels and casting wheel surface. Thus the actual tangential contact point between the belt and the casting wheel was not directly under the guide wheel.

The silicone coated fiberglass hugger belt showed no evidence of excessive heating. The belt appeared to be unaffected by the temperature and heat radiation to which it was exposed.

The metallic glass ribbon was successfully trapped under the hugger belt. The ribbon stayed on the surface of the casting wheel between the casting point and the point where it was trapped under the belt during the entire run. There appeared no tendency of the ribbon to lift off the surface of the casting wheel between the casting point and the point where it passed under the hugger belt. The belt retained the edges of the cast ribbon close and firm to the casting wheel. At the belt departure point the ribbon showed a slight tendency to remain close to the casting wheel surface for a few degrees but no further. No excessive vibrations were generated by the moving belts.

The belt was successfully driven by the casting wheel. It appeared that the belt did not slip on the casting wheel surface.

With the belt contacting the rotating casting wheel there was no apparent damage to the casting wheel surface. A very faint darkening was present on the belt, but there appeared to be no deposit or film on the surface of the belt.

The ribbon produced with the apparatus of the present invention had no obvious waviness. The rbbon produced appeared to be flat.

Since various changes and modifications may be made in the invention without departing from the spirit and essential characteristics, it is intended that all metal contained in the above descriptions shall be interpreted as illustrative only of the invention being limited only by the scope of the appended claims.

What is claimed:

1. In an apparatus for the production of continuous metal strip by depositing molten metal onto the peripheral surface of a rapidly rotating annular chill roll, said apparatus including an annular chill roll adpated for rapid rotation around its longitudinal axis having a flat peripheral casting surface, and means for depositing molten metal onto said casting surface for rapid solidification thereon to form a continuous metal filament, the improvement which comprises provision of an elastomeric, flexible belt being carried in frictional engagement with said casting surface in an arcuate portion of at least 120° around said chill roll beginning at a point upstream from the point where the filament would be flung away from the casting surface by action of centrifugal force, adapted to urge said solidified filament into contact with said casting surface, said belt being supported by at least three guide wheels, said belt being wider than the filament, so that it overlaps the marginal portions of the filament, and direct contact between the casting surface and the belt is established immediately adjacent to the marginal portions of the filament.

2. The apparatus as set forth in claim 1 wherein the belt comprises a cord reinforced elastomer.

3. The apparatus as set forth in claim 2 wherein the reinforcement is provided by a fiberglass cord.

4. The apparatus as set forth in claim 2 wherein the reinforcement is provided by a metal filament cord.

5. The apparatus as set forth in claim 2 where the elastomer is a silicone elastomer.

6. The apparatus as set forth in claim 1 further comprising means for tightening the belt acting upon at least one of the guide wheels.

7. The apparatus as set forth in claim 1 further comprising guide means attached to one of the guide wheels for fixing the position of the belt in the direction of the rotational axis of the wheel.

8. The apparatus as set forth in claim 1 wherein the guide means are flanges attached to at least one of the guide wheels.

* * * * *